United States Patent [19]

Berry

[11] 4,012,159

[45] Mar. 15, 1977

[54] KEY-JOINT FORMING DIVIDER STRIP AND SCREED FOR USE WITH CONCRETE SLABS

[75] Inventor: Homer E. Berry, Parsons, Kans.

[73] Assignee: Superior Concrete Accessories, Inc., Franklin Park, Ill.

[22] Filed: Mar. 22, 1976

[21] Appl. No.: 668,818

[52] U.S. Cl. ..... 404/68; 404/48; 404/50

[51] Int. Cl.[2] ..... E01C 11/02

[58] Field of Search ..... 404/68, 69, 47, 48, 404/50, 51; 52/396

[56] References Cited

UNITED STATES PATENTS

| | | | |
|---|---|---|---|
| 2,848,929 | 8/1958 | Wilbur | 404/51 |
| 3,057,269 | 10/1962 | Artigalas | 404/50 |
| 3,143,783 | 8/1964 | Gaetke | 404/51 |
| 3,238,856 | 3/1966 | Jahn | 404/68 X |
| 3,357,324 | 12/1967 | Tone | 404/68 |
| 3,437,018 | 4/1969 | Jackson | 404/50 |
| 3,572,225 | 3/1971 | Burton | 404/47 |
| 3,784,313 | 1/1974 | Collier | 404/51 |

*Primary Examiner*—Nile C. Byers
*Attorney, Agent, or Firm*—Norman H. Gerlach

[57] ABSTRACT

A divider strip with an upstanding screed for use in connection with the pouring of a pair of adjoining concrete slabs, such strip being designed to be supported by a horizontal series of laterally and substantially equidistantly spaced stakes which are set below a predetermined grade level, and, in addition, being adapted when in its operative position to have wet concrete poured on opposite sides thereof in order to form a pair of adjoining slabs with at least one key joint therebetween. A particular bend arrangement at the upper edge or marginal region of the divider strip establishes an upstanding, inverted U-shaped, screed section having inner and outer vertical walls which have the upper edge regions thereof cross-connected by an integral flat top wall and are spaced apart a distance of less magnitude than the thickness of the stakes to which the divider strip is applied, the outer vertical wall being provided with a laterally out-turned horizontal flange which establishes a downwardly facing seating and impact shelf or shoulder for the upper ends of the associated stakes. A spring apron depends from the distal or outer edge of the seating shelf and is inclined inwardly for frictional engagement with the adjacent portions of the upper ends of the stakes so as to maintain the main body of the strip in firm gripping relation with the upper ends of the stakes. The lower marginal portion of the spring apron is turned outwardly so that it extends downwards and outwards and establishes a cam surface whereby the divider strip may be manually and telescopically slipped over and "hung" so to speak upon the stakes in supporting relationship prior to concrete-pouring operations for slab-forming purposes.

2 Claims, 6 Drawing Figures

KEY-JOINT FORMING DIVIDER STRIP AND SCREED FOR USE WITH CONCRETE SLABS

The present invention relates to a screed-equipped key-joint forming divider strip which preferably is formed from sheet metal or the like and is used between adjacent slabs of poured concrete to form between the slabs a tongue and groove type of interlocking key-joint which allows for expansion and contraction of the slabs due to changes in temperatures while at the same time preventing relative vertical displacement of the two slabs. Key-joint forming divider strips of the general type to which the present invention relates are widely used in the formation of concrete slabs for use in concrete roadways, building floors, airfield runways, and the like.

In general, previously designed key-joint forming divider strips are in the form of elongated sheet metal pieces, the lower regions of which are formed with coextensive laterally offset portions in order to establish the desired key-joint in the adjacent poured concrete slabs and the upper regions of which have folded-over or bent portions in order to form upstanding screeds which have horizontally linearly straight upper edges and are adapted to support screed boards or rods in connection with concrete levelling operations. In between such lower and upper regions of the strips, there are usually provided recesses, sockets or downwardly facing channels for reception of the upper ends of the stakes which are used in connection with the strips. The nature of such stake-receiving recesses, sockets or channels varies widely in connection with both the stake-receiving and screed-forming facilities of previously designed and used key-joint forming divider strips.

One of the principal objects of the invention is to provide a screed-equipped key-joint forming divider strip which is an improvement upon and has certain inherent advantages over the divider strips which are shown and described in U.S. Pat. Nos. 3,143,783, 3,288,042 and 3,357,324, and is characterized by the fact that it is lighter in weight, less costly to produce and more efficient than such patented divider strips.

A further and important object of the invention is to provide a screed-equipped key-joint forming divider strip having an upper screed section which is of hollow inverted U-shaped cross section and embodies parallel side walls which are spaced apart a distance somewhat less than the thickness of the stakes which are to receive the divider strip thereon in supporting relationship, one of such side walls being turned laterally outwardly so as to define a downwardly facing seating shelf or shoulder which, at least in part, seats upon the upper end edges of the associated stakes, and one of such side walls having depending therefrom a downwardly and inwardly directed apron which, when the upper ends of the stakes are caused to engage the seating shoulder, yieldingly bears against the stakes and, in combination with the main body of the strip, exerts a clamping or gripping action on the stakes, thus stabilizing the divider strip as a whole and maintaining it in its proper fixed position for concrete-pouring operations.

Other objects and advantages of the invention, not at this time enumerated, will readily suggest themselves as the following description ensues.

The invention consists in the several novel features which are hereinafter set forth and are more particularly defined by claims at the conclusion hereof.

In the accompanying two sheets of drawings forming a part of this specification, one illustrative embodiment of the invention is illustrated.

Figure 1:
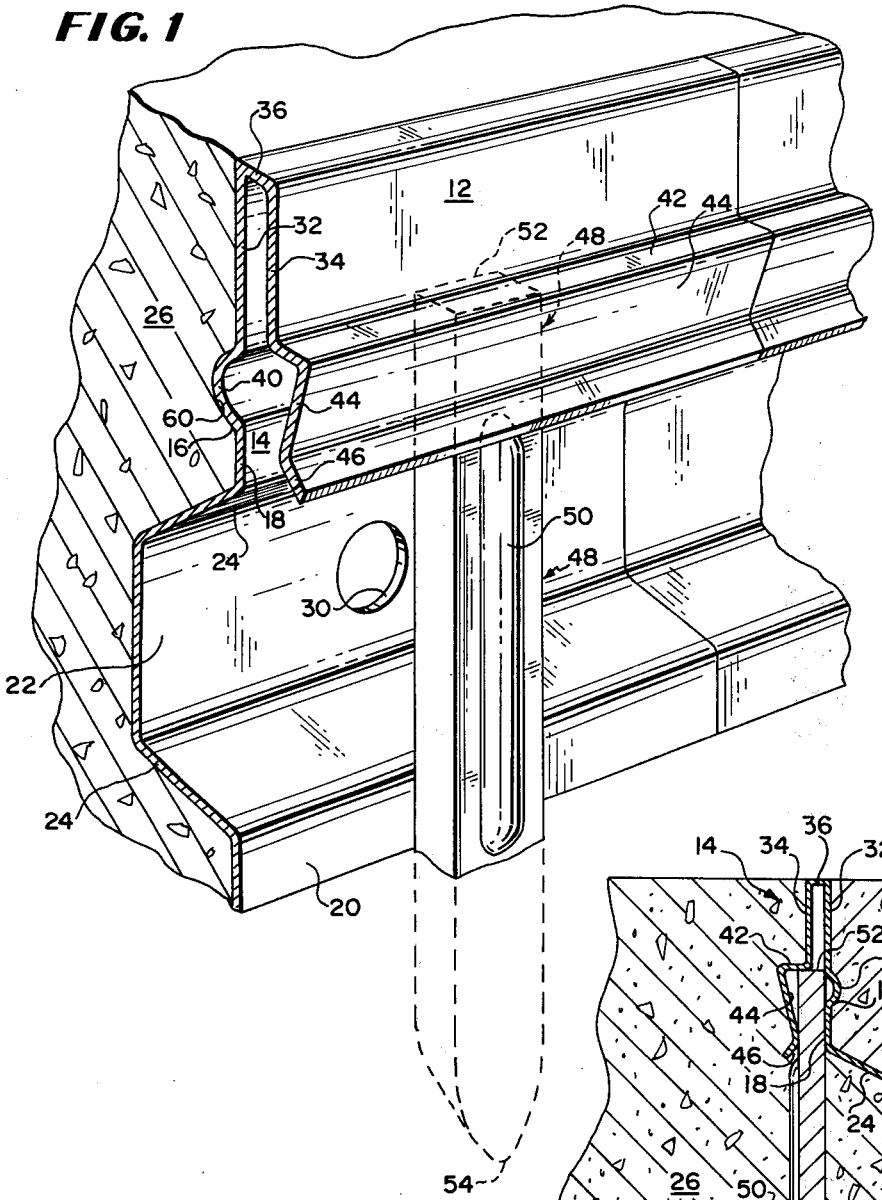
FIG. 1 is a fragmentary perspective view, partly in section, showing the improved screed-equipped key-joint forming divider strip of the present invention operatively installed in a concrete slab formation but with the slab-forming concrete on one side of the strip remaining unpoured.

Referring now to the drawings in detail, a screed-equipped key-joint forming divider strip embodying the principles of the present invention is designated in its entirety by the reference numeral 10 and it is preferably made from sheet steel or aluminum, although it is contemplated that in certain instances a suitable plastic material may be employed. The strip may be fabricated by effecting appropriate folds or bends in a sheet of steel or other flat blank of material, or alternatively, by an extruding operation.

The strip involves in its general organization a lower key-joint forming section 12 and an inverted U-shaped, upper screed section 14, the two sections being connected together by an integral juncture region 16.

Figure 2:
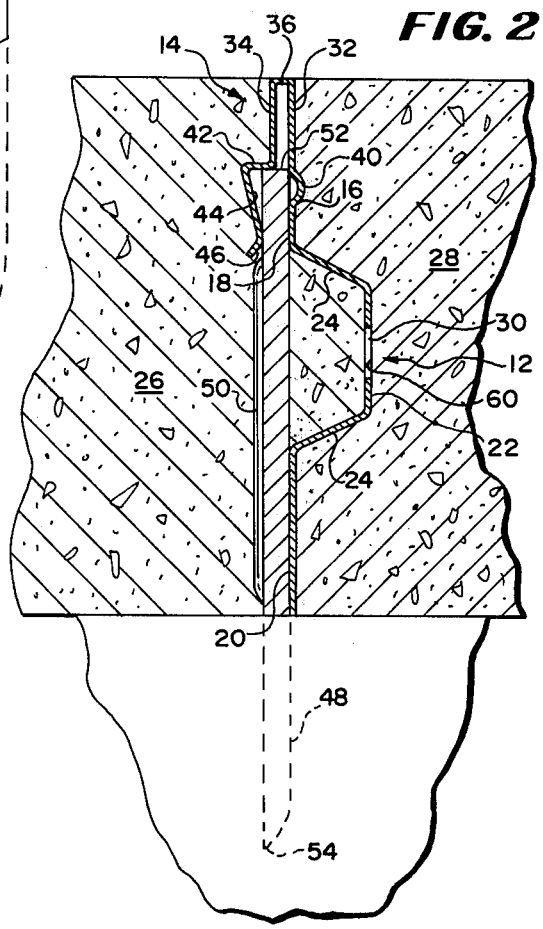
FIG. 2 is a fragmentary vertical sectional view taken through the structure of FIG. 1, but with both concrete slabs being shown as being fully poured.

The lower key-joint forming section 12 consists of upper and lower coplanar parts 18 and 20 and a laterally offset intermediate part 22, the latter being connected to the parts 18 and 20 by integral wall-like parts 24 which converge in the direction of the laterally offset intermediate part 22. The converging parts 24 together with the laterally offset intermediate part 22 form a longitudinally extending channel of key deformation portion which is adapted to form a tongue and groove joint between the adjacent side faces of a pair of adjoining concrete slabs, such, for example, as the slabs 26 and 28, when the concrete for the latter is poured on opposite sides of the divider strip 10 after installation of the strip as shown in FIG. 2 of the drawings. If desired, the laterally offset intermediate part 22 may be provided with knock-out plugs or disks (not shown) which when punched or pushed out leave a number of longitudinally spaced holes or apertures 30 for reception therethrough of horizontally extending dowels or other rods (not shown) as is conventional in connection with key-joint forming divider strips of the character under consideration.

The arrangement of the lower key-joint forming section 12 of the divider strip 10 as heretofore described is entirely conventional and no claim is made herein to any novelty therein, the novelty of the present invention residing rather in the nature, design, and arrangement of the upper screed section 14 by means of which the divider strip as a whole is operatively installed upon a series of aligned ground-driven stakes as will now be described in detail.

Figure 3:
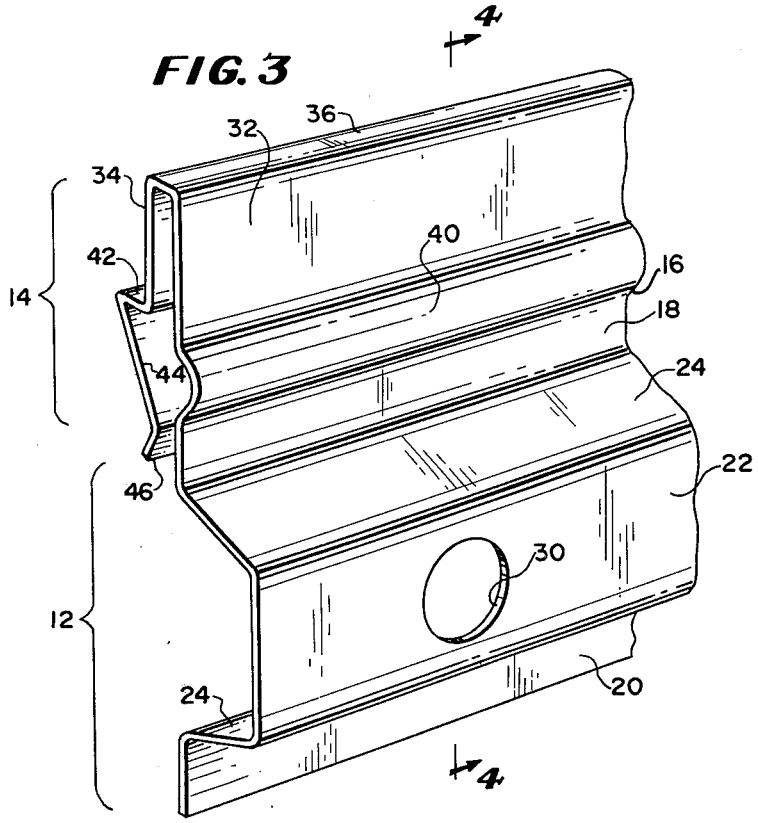
FIG. 3 is an enlarged fragmentary perspective view of the improved divider strip in its free state, that is, before use thereof as intended.
Figure 4:
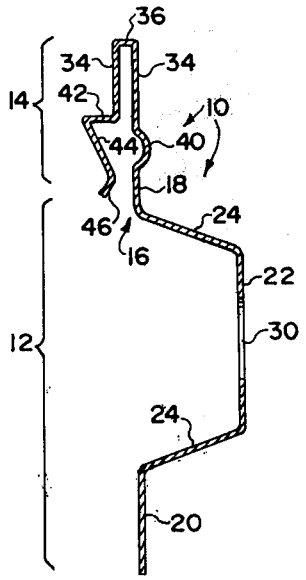
FIG. 4 is a vertical transverse sectional view taken substantially on the vertical plane indicated by the line 4—4 of FIG. 3 and in the direction of the arrows.

Referring now to FIGS. 3 and 4 of the drawings, the screed section 14 of the divider strip 12 is established by a hollow inverted U-shaped structure which is located at the upper region of the divider strip 10 and includes a vertical wall portion 32, which will hereinafter be referred to as the inner wall portion and is coplanar with an upper extension of the aforementioned upper planar part 18, and a vertical outer wall portion 34, the two wall portions being disposed in parallel relation and spaced apart a certain distance as described hereafter. The two vertical wall portions 32 and 34 of the aforesaid inverted U-shaped structure have their upper edges connected together by an integral flat top wall or bridge portion 36 which extends horizontally and, as will be described subsequently, constitutes or defines in effect a narrow horizontal screed surface. As shown in the drawings, the upper edges of the two vertical wall portions 32 and 34 and the side edges of the top wall 36 are integrally connected together by sharp right-angle bends in order to reduce spalling to a minimum.

The lower margin of the inner wall portion 32 is formed with an outwardly extending rib-like bulge 40 which is joined to the upper planar part 18 while the lower margin of the outer wall portion 34 is turned laterally outwardly in order to provide a right-angle bend which establishes a horizontal downwardly facing seating and impact shelf or shoulder 42, the function of which will be made clear presently. The outer marginal portion of the seating and impact shelf or shoulder 42 is turned or bent downwardly and slightly inwardly to form a portion 44 and then is turned or bent so that it extends slightly outwards and downwards to form a portion 46, the two portions 44 and 46 establishing respectively a spring apron, and a cam surface the nature and function of which will likewise be described subsequently. The parts 34 and 42 of the outer wall portion of the screed section 14 of the divider strip 12 constitute, in effect, an upper component of said outer wall portion, and the parts 44 and 46 constituting, in effect, a depending lower component of the vertical inner wall portion of said screed section 14. The key-joint forming divider strip 10 of the present invention is adapted to be suspended on and supported by a straight horizontal row of equidistantly spaced apart vertically extending stakes 48, only one of which is shown in FIGS. 1, 2, 5 and 6 of the drawings. Such stakes are of conventional construction and a wide variety of such stakes are available for use in connection with the present divider strip 10. The particular stake 48 which is illustrated in the drawings is in the form of a vertically elongated steel or other metal member which is preferably, but not necessarily, provided with a longitudinally extending reinforcing or stiffening rib 50 and embodies a flat head portion 52 (see particularly FIGS. 1, 2, 5 and 6) at its upper end, and a point 54 (see FIGS. 1 and 2) at its lower end. When the divider strip 10 is applied to the stakes 48, the flat head portions 52 project between the spring apron which is formed by the bent portions 46 and 48, and the vertical part 18 of the divider strip 10 and bears against the underneath side of the horizontal seating shelf or shoulder 42 as clearly shown in FIGS. 2 and 6. This seating of the shoulder 42 on the flat head portions 52 of the stakes is made possible by reason of the fact that the vertical wall portions 34 and 36 of the aforementioned inverted U-shaped structure are spaced apart a distance which is somewhat less than the thickness of the stakes 48.

Figure 5:
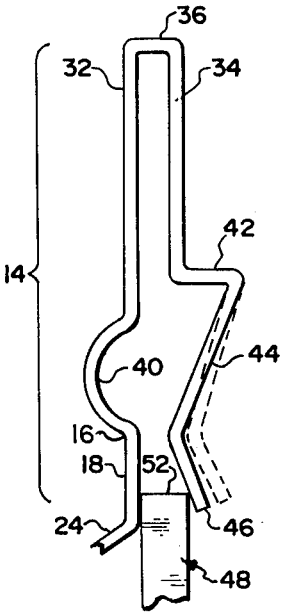
FIGS. 5 and 6 are enlarged fragmentary edge elevational views of the screed-portion of the divider strip, such views illustrating schematically the manner in which the strip is applied to an associated upstanding stake.
Figure 6:
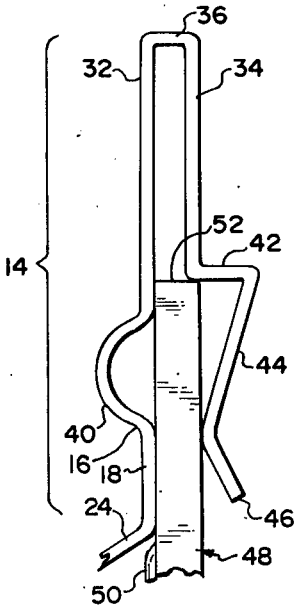

Installation of the divider strip 10 is made as illustrated in FIGS. 1, 5 and 6 of the drawings, the first step being to drive the stakes 48 along a surveyed line which defines an edge of the concrete slab which is first to be poured, the stakes being suitably driven to a suitable depth to the end that their upper ends or head portions 52 will be positioned uniformly a predetermined distance below grade level. Thereafter, the divider strip 10 is applied to the stakes by manipulating it so as to cause the strip to descend in the manner shown in FIG. 5 until the head portions of the stakes engage the out-turned portion or cam surface 46 of the aforementioned spring apron, after which the head portions 52 of the stakes will exert a camming action on the apron and force the same yieldingly outwardly to the position in which it is shown in FIG. 6, descent of the divider strip being continued until the horizontal seating and impact shelf or shoulder 42 comes to rest upon the head portions 52 of the stakes with the spring apron 44, 46 frictionally engaging the stakes. As best shown in FIG. 5 of the drawings, the downwardly and inwardly extending portion or spring apron 44 and the out-turned portion or cam surface 46 are joined together by an inwardly extending apex portion which prior to application of the divider strip 10 to the upper ends of the stakes 48 is spaced from the upper part 18 of the lower key-joint section 12 a distance less than the thickness of the upper ends of the stakes, and this results in the spring apron 44 serving yieldingly to draw said upper and lower coplanar parts 18 and 20 firmly against the stakes.

The application of the divider strip 10 in this manner to the upper ends or head portions of the aligned stakes 48 may be entirely a manual one, but if any particular degree of resistance to such application is encountered in the vicinity of any given stake, a light tapping of the strip with a suitable impact tool such as a hammer may be resorted to in order to bring the seating and impact shelf or shoulder 42 into contact with the upper end of the stake. Such tapping may be effected either upon the flat top wall or bridge portion 36 or upon the seating and impact shelf or shoulder 42 itself and it may be resorted to, not only to cause the shelf or shoulder 42 to seat squarely upon the upper ends of the stakes, but also to lower the elevation of a particular stake after the divider strips 10 have been applied to the stakes.

Concrete-pouring operations are preferably performed by pouring wet concrete on the male or convex side of the divider strip 10 in order to produce the slab 26 of FIGS. 1 and 2. When this is done, the pressure of the poured concrete will serve to press the divider strip 10 firmly against the stakes 48, while at the same time a horizontal key groove 60 is formed in the adjacent side surface or edge portion of the poured and formed slab 26. Immediately after pouring of the slab 26, the slab 28 may be poured on the opposite female or concave side of the divider strip 10, and when this is done, the concrete will flow into the aforementioned key groove or slot 60 and also in encompassing relation with the various stakes 48, thereby stabilizing the strip which is merely hung upon such stakes. The second pouring operation will establish on the side edge of the slab 28 which is adjacent to the slab 26 a concrete key 62 which registers with and projects into the key groove 60. The lateral rib-like bulge 40 also establishes a second but smaller key-joint including a groove 64 and a concrete key 66. In addition, the bulge 40 serves as a stiffening medium for the divider strip as a whole.

Immediately after pouring of the concrete on opposite sides of the divider strip 10 in order to form the slabs 26 and 28, a screeding or levelling operation will normally be resorted to in the usual manner. This is accomplished by resting a screed bar or rod in a horizontal position on the narrow flat top wall 36 of the upper screed section 14 of the divider strip 10 and then moving the bar or rod back and forth over the upper surfaces of the two slabs 26 and 28 in order to effect truly horizontal surfaces and effect clean edges when the concrete shrinks and hardens.

Under certain circumstances, it may be found desirable first to make the initial concrete pour in order to produce the slab 26 and then, after permitting the concrete to harden, to remove the entire divider strip and its associated stakes before making the second pour. However, the cost of the divider strip and its associated stakes is sufficiently low that economy may be attained by leaving the strip and stakes in situ for permanent embedment in the concrete installation.

The invention is not to be limited to the exact arrangement of parts shown in the accompanying drawings or described in this specification as various changes in the details of construction may be resorted to without departing from the spirit or scope of the invention. For example, the horizontal downwardly facing seating and impact shelf or shoulder 42 may be connected to and extend outwards from the lower edge region of the vertical inner wall portion 32 instead of the vertical outer wall portion 34. Therefore, only insofar as the invention is particularly pointed out in the accompanying claims is the same to be limited.

Having thus described the invention what I claim as new and desire to secure by letters patent is:

1. A forming unit adapted to establish a key-joint between a pair of adjacent concrete slabs and comprising, in combination, a plurality or horizontally aligned and spaced stakes having relatively thick upper ends and set with such ends uniformly below grade level, and a horizontally elongated divider strip formed of sheet material, supported on said stakes and bridging the distance between each pair of stakes, said divider strip having a lower key-joint forming section and an upper vertically extending screed section, said lower key-joint forming section having upper and lower vertical coplanar parts abutting against the adjacent sides of the stakes, and an intermediate laterally offset key deformation portion extending between and connecting said upper and lower coplanar parts, said vertically extending screed section being in the form of a hollow inverted U-shaped structure extending along the upper region of said divider strip and including a vertical inner wall portion which is connected to said upper part of the lower key-joint forming section, a vertical outer wall portion consisting of an upper component positioned in opposed and parallel relation with said inner wall portion and spaced from the latter a distance less than the thickness of the upper end of a stake, and a depending lower component, and a narrow planar horizontal top wall extending between the upper regions of said vertical inner and outer wall portions, connected thereto by sharp right angle bends, and constituting a screed surface of appreciable width, one of said vertical wall portions being formed directly beneath the inverted U-shaped structure with a right angle bend which establishes an outwardly extending seating and impact shoulder which bears against and is seated upon the upper ends of said stakes, the lower component of said outer vertical wall portion extending downwardly and inwardly in order to form beneath the level of said seating and impact shoulder a spring apron which yieldingly bears against the other sides of said stakes and serves to draw said upper and lower coplanar parts against the stakes, the lower edge region of said spring apron being turned outwardly and establishing a cam surface which, upon application of the divider strip to the stakes, serves to flex the apron outwardly so as to receive the upper ends of the stakes between said upper part of the lower key-joint section and the apron, said downwardly and inwardly extending spring apron and the out-turned lower edge region thereof being joined together by an inwardly extending apex portion which prior to application of the divider strip to the upper ends of the stakes is spaced from said upper part of the lower key-joint section a distance less than the thickness of said upper ends of the stakes.

2. A forming unit adapted to establish a key-joint between a pair of adjacent concrete slabs and comprising, in combination, a plurality of horizontally aligned and spaced stakes having relatively thick upper ends and set with said upper ends uniformly below grade level, and a horizontally elongated divider strip formed of sheet material, supported on said stakes and bridging the distance between each pair of adjacent stakes, said divider strip having a lower key-joint forming section and an upper vertically extending screed section, said lower key-joint forming section including upper and lower vertical coplanar parts abutting against the adjacent sides of the stakes, and an intermediate laterally offset key deformation portion extending between and connecting said upper and lower coplanar parts, said vertically extending screed section being in the form of a hollow inverted U-shaped structure extending along the upper region of said divider strip and including a vertical inner wall portion which is coplanar with and connected to said upper part of the lower key-joint forming section, a vertical outer wall portion consisting of an upper component positioned in opposed and parallel relation with said inner wall portion and spaced from the latter a distance approximately equal to one-half the thickness of the upper end of a stake, and a depending lower component, and a narrow planar horizontal top wall extending between the upper edge regions of said vertical wall portions, connected thereto by sharp right angle bends and constituting a screed surface of appreciable width, the lower margin of the upper component of said outer wall portion being formed with a right angle bend which establishes an outwardly extending horizontal seating and impact shoulder which bears against and is seated upon the upper ends of said stakes the depending lower component of the outer wall portion having its upper edge region connected to the outer edge region of said seating shoulder and extending downwardly and inwardly in order to form a spring apron which yieldingly bears against the other sides of said stakes and serves to draw said upper and lower coplanar parts of the lower key-joint forming section against the stakes, the lower edge of said spring apron being formed with an out-turned portion which establishes a cam surface whereby, upon application of the divider strip to said stakes, the upper ends of the latter will cause said spring apron to flex bodily outwards so as to receive the upper ends of the stakes between said upper part of the lower key-joint forming section and the apron, said downwardly and inwardly extending spring apron and the out-turned lower edge region thereof being joined together by an inwardly extending apex portion which prior to application of the divider strip to the upper ends of the stakes is spaced from said upper part of the lower key-joint section a distance appreciably less than the thickness of said upper ends of the stakes.

* * * * *